US008255213B2

(12) United States Patent
Yoshida et al.

(10) Patent No.: US 8,255,213 B2
(45) Date of Patent: Aug. 28, 2012

(54) SPEECH DECODING APPARATUS, SPEECH ENCODING APPARATUS, AND LOST FRAME CONCEALMENT METHOD

(75) Inventors: Koji Yoshida, Kanagawa (JP); Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 752 days.

(21) Appl. No.: 12/373,085

(22) PCT Filed: Jul. 11, 2007

(86) PCT No.: PCT/JP2007/063815

§ 371 (c)(1),
(2), (4) Date: Jan. 9, 2009

(87) PCT Pub. No.: WO2008/007700

PCT Pub. Date: Jan. 17, 2008

(65) Prior Publication Data

US 2009/0319264 A1 Dec. 24, 2009

(30) Foreign Application Priority Data

Jul. 12, 2006 (JP) ..... 2006-192070

(51) Int. Cl.
*G10L 19/00* (2006.01)

(52) U.S. Cl. ..... 704/230; 704/223; 704/221

(58) Field of Classification Search ..... 704/223, 704/222, 208, 214, 221, 219, 206, 207, 211, 704/200, 230

See application file for complete search history.

(56) References Cited

U.S. PATENT DOCUMENTS

| | | | | |
|---|---|---|---|---|
| 5,615,298 | A | 3/1997 | Chen | |
| 5,699,485 | A * | 12/1997 | Shoham | 704/223 |
| 5,960,389 | A | 9/1999 | Jarvinen et al. | |
| 6,606,593 | B1 | 8/2003 | Jarvinen et al. | |
| 6,636,829 | B1 | 10/2003 | Benyassine et al. | |
| 7,587,315 | B2 * | 9/2009 | Unno | 704/223 |
| 7,590,525 | B2 * | 9/2009 | Chen | 704/211 |
| 2003/0046064 | A1 | 3/2003 | Moriya et al. | |
| 2003/0142699 | A1 | 7/2003 | Suzuki et al. | |
| 2005/0154584 | A1 | 7/2005 | Jelinek et al. | |
| 2007/0150262 | A1 | 6/2007 | Mori et al. | |

(Continued)

FOREIGN PATENT DOCUMENTS

JP 2004-102074 A 4/1994

(Continued)

OTHER PUBLICATIONS

English language Abstract of JP 2003-249957 A.

*Primary Examiner* — Huyen X. Vo

(74) *Attorney, Agent, or Firm* — Greenblum & Bernstein, P.L.C.

(57) ABSTRACT

A sound decoding device is capable of improving the lost frame compensation performance and improving quality of the decoded sound. A rise frame sound source compensation unit generates a compensation sound source signal when the current frame is a lost frame and a rise frame. An average sound source pattern update unit updates the average sound source pattern held in an average sound source pattern holding unit over a plurality of frames. When a frame is lost, an LPC synthesis unit performs LPC synthesis on a decoded sound source signal by using the compensation sound source signal inputted via a switching unit and a decoded LPC parameter from an LPC decoding unit and outputs the compensation decoded sound signal.

16 Claims, 4 Drawing Sheets

U.S. PATENT DOCUMENTS

| | | | |
|---|---|---|---|
| 2007/0299669 | A1 | 12/2007 | Ehara |
| 2008/0010072 | A1 | 1/2008 | Yoshida et al. |
| 2008/0052066 | A1 | 2/2008 | Oshikiri et al. |
| 2008/0091419 | A1 | 4/2008 | Yoshida et al. |

FOREIGN PATENT DOCUMENTS

| | | | |
|---|---|---|---|
| JP | 7-311597 | A | 11/1995 |
| JP | 10-190498 | A | 7/1998 |
| JP | 2003-223189 | A | 8/2003 |
| JP | 2003-249957 | A | 9/2003 |
| JP | 2003-332914 | A | 11/2003 |
| JP | 2004-138756 | A | 5/2004 |
| JP | 2004-206132 | A | 7/2004 |
| JP | 2005-534950 | A | 11/2005 |
| WO | 2005/109402 | | 11/2005 |

* cited by examiner

SPEECH DECODING APPARATUS, SPEECH ENCODING APPARATUS, AND LOST FRAME CONCEALMENT METHOD

TECHNICAL FIELD

The present invention relates to a speech decoding apparatus, speech encoding apparatus, and lost frame concealment method.

BACKGROUND ART

A speech codec for VoIP (Voice over IP) use is required to have high packet loss tolerance. It is desirable for a next-generation VoIP codec to achieve error-free quality even at a comparatively high frame loss rate (for example, 6%).

In the case of CELP speech codecs, there are many cases in which quality degradation due to frame loss in a speech onset portion is a problem. The reason for this may be that signal variation is great and correlativity with the signal of the preceding frame is low in an onset portion, and therefore concealment processing using preceding frame information does not function effectively, or that in a frame of a subsequent voiced portion, an excitation signal encoded in the onset portion is actively used as an adaptive codebook, and therefore the effects of loss of an onset portion are propagated to a subsequent voiced frame, tending to cause major distortion of a decoded speech signal.

In response to the above kind of problem, a technology has been developed whereby encoded information for concealment processing when a preceding or succeeding frame is lost is transmitted together with current frame encoded information (see Patent Document 1, for example). With this technology, it is determined whether or not a preceding frame false signal (or succeeding frame false signal) can be created by synthesizing a preceding frame (or succeeding frame) concealed signal by repetition of a current frame speech signal or extrapolation of a characteristic amount of that code, and comparing this with the preceding frame signal (or succeeding frame signal), and if it is determined that creation is not possible, a preceding subcode (or succeeding subcode) is generated by a preceding sub-encoder (or succeeding sub-encoder) based on a preceding frame signal (or succeeding frame signal), and it is possible to generate a high-quality decoded signal even if a preceding frame (succeeding frame) is lost by adding a preceding subcode (succeeding subcode) to the main code of the current frame encoded by a main encoder.

Patent Document 1: Japanese Patent Application Laid-Open No. 2003-249957

DISCLOSURE OF INVENTION

Problems to be Solved by the Invention

However, with the above technology, a configuration is used whereby preceding frame (past frame) encoding is performed by a sub-encoder based on current frame encoded information, and therefore a codec method is necessary that enables high-quality decoding of a current frame signal even if preceding frame (past frame) encoded information is lost. Therefore, it is difficult to apply this to a case in which a predictive type of encoding method that uses past encoded information (or decoded information) is used as a main layer. In particular, when a CELP speech codec utilizing an adaptive codebook is used as a main layer, if a preceding frame is lost, decoding of the current frame cannot be performed correctly, and it is difficult to generate a high-quality decoded signal even if the above technology is applied.

It is an object of the present invention to provide a speech decoding apparatus, speech encoding apparatus, and lost frame concealment method that enable lost frame concealment performance to be improved and decoded speech quality to be improved.

Means for Solving the Problems

The present invention employs the following sections in order to solve the above problems.

Namely, a speech decoding apparatus of the present invention employs a configuration having: a decoding section that decodes input encoded data to generate a decoded signal; a generation section that generates an average waveform pattern of an excitation signal in a plurality of frames using an excitation signal obtained in the process of decoding the encoded data; and a concealment section that generates a concealed frame of a lost frame using the average waveform pattern.

Advantageous Effect of the Invention

According to the present invention, lost frame concealment performance can be improved and decoded speech quality can be improved.

BEST MODE FOR CARRYING OUT THE INVENTION

An embodiment of the present invention will now be described in detail with reference to the accompanying drawings.

Embodiment 1

Figure 1:
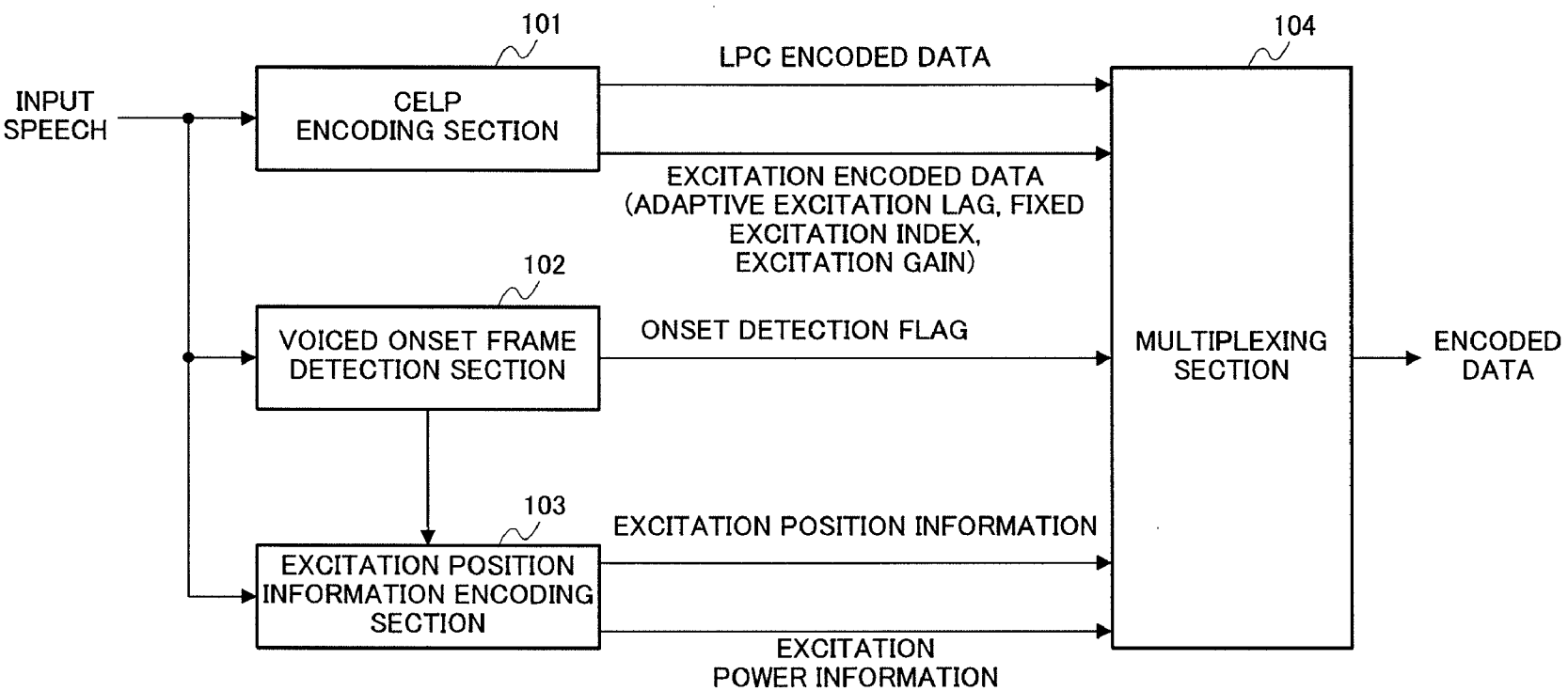
FIG. 1 is a block diagram showing the main configuration of a speech encoding apparatus according to Embodiment 1 of the present invention.

FIG. 1 is a block diagram showing the main configuration of a speech encoding apparatus according to Embodiment 1 of the present invention.

A speech encoding apparatus according to this embodiment is equipped with CELP encoding section 101, voiced onset frame detection section 102, excitation position information encoding section 103, and multiplexing section 104.

The sections of a speech encoding apparatus according to this embodiment perform the following operations in frame units.

CELP encoding section 101 performs encoding by means of a CELP method on a frame-unit input speech signal, and outputs generated encoded data to multiplexing section 104. Here, encoded data typically includes LPC encoded data and excitation encoded data (adaptive excitation lag, fixed excitation index, excitation gain). Other equivalent encoded data such as LSP parameters may be used instead of LPC encoded data.

Voiced onset frame detection section 102 determines for a frame-unit input speech signal whether or not the relevant frame is a voiced onset frame, and outputs a flag indicating the determination result (an onset detection flag) to multiplexing section 104. A voiced onset frame is a frame for which the starting point (onset portion) of a particular voiced speech signal is present in the frame in a signal having pitch periodicity. There are various methods of determining whether or not a frame is a voiced onset frame. For example, speech signal power or temporal variation of the LPC spectrum may be observed, and a frame determined to be a voiced onset frame in the case of a sudden change. This may also be performed using the presence or absence of voicedness or the like.

From input speech of a frame determined to be a voiced onset frame, excitation position information encoding section 103 calculates excitation position information and excitation power information for that frame, and outputs these items of information to multiplexing section 104. Here, excitation position information and excitation power information are information for stipulating a placement position in a concealed frame of an average excitation pattern and concealed excitation signal gain when excitation signal concealment using an average excitation pattern described later herein is performed on a lost frame. In this embodiment, generation of a concealed excitation using an average excitation pattern is applied only to a voiced onset frame, and therefore that average excitation pattern is an excitation waveform having pitch periodicity (a pitch-periodic excitation). Therefore, phase information for that pitch-periodic excitation is found as excitation position information. Typically, a pitch-periodic excitation often has a pitch peak, and a pitch peak position in the frame (relative position in the frame) is found as phase information. There are various methods of calculating this. For example, a signal sample position having the largest amplitude value may be calculated as a pitch peak position from an LPC Prediction residual signal for an input speech signal or an encoded excitation signal obtained by CELP encoding section 101. The power of an excitation signal of the relevant frame can be calculated as excitation power information. An average amplitude value of an excitation signal of the relevant frame may be found instead of power. Furthermore, in addition to power or an average amplitude value, the polarity (positivity/negativity) of an excitation signal of a pitch peak position may also be found as a part of excitation power information. Excitation position information and excitation power information are calculated in frame units. Moreover, if a plurality of pitch peaks are present in a frame—that is, if there are pitch-periodic excitations of one pitch period or more—the rearmost pitch peak is focused on, and only this pitch peak position is encoded. This is because the rearmost pitch peak probably has the largest influence on the next frame, and making that pitch peak subject to encoding can be considered to be the most effective way of increasing encoding accuracy at a low bit rate. Calculated excitation position information and excitation power information are encoded and output.

Multiplexing section 104 multiplexes encoded data obtained by processing in CELP encoding section 101 through excitation position information encoding section 103, and transmits this to the decoding side as transmit encoded data. Excitation position information and excitation power information are multiplexed only when the onset detection flag indicates that a frame is a voiced onset frame. The onset detection flag, excitation position information, and excitation power information are multiplexed with CELP encoded data of the next frame after the relevant frame, and are transmitted.

Thus, a speech encoding apparatus according to this embodiment performs CELP encoding on a frame-unit input speech signal and generates CELP encoded data, and also determines whether or not the current frame subject to processing corresponds to a voiced onset frame, and in the case of a voiced onset frame calculates information relating to pitch peak position and power, and multiplexes and outputs calculated information encoded data together with the above CELP encoded data and onset detection flag.

Figure 2:
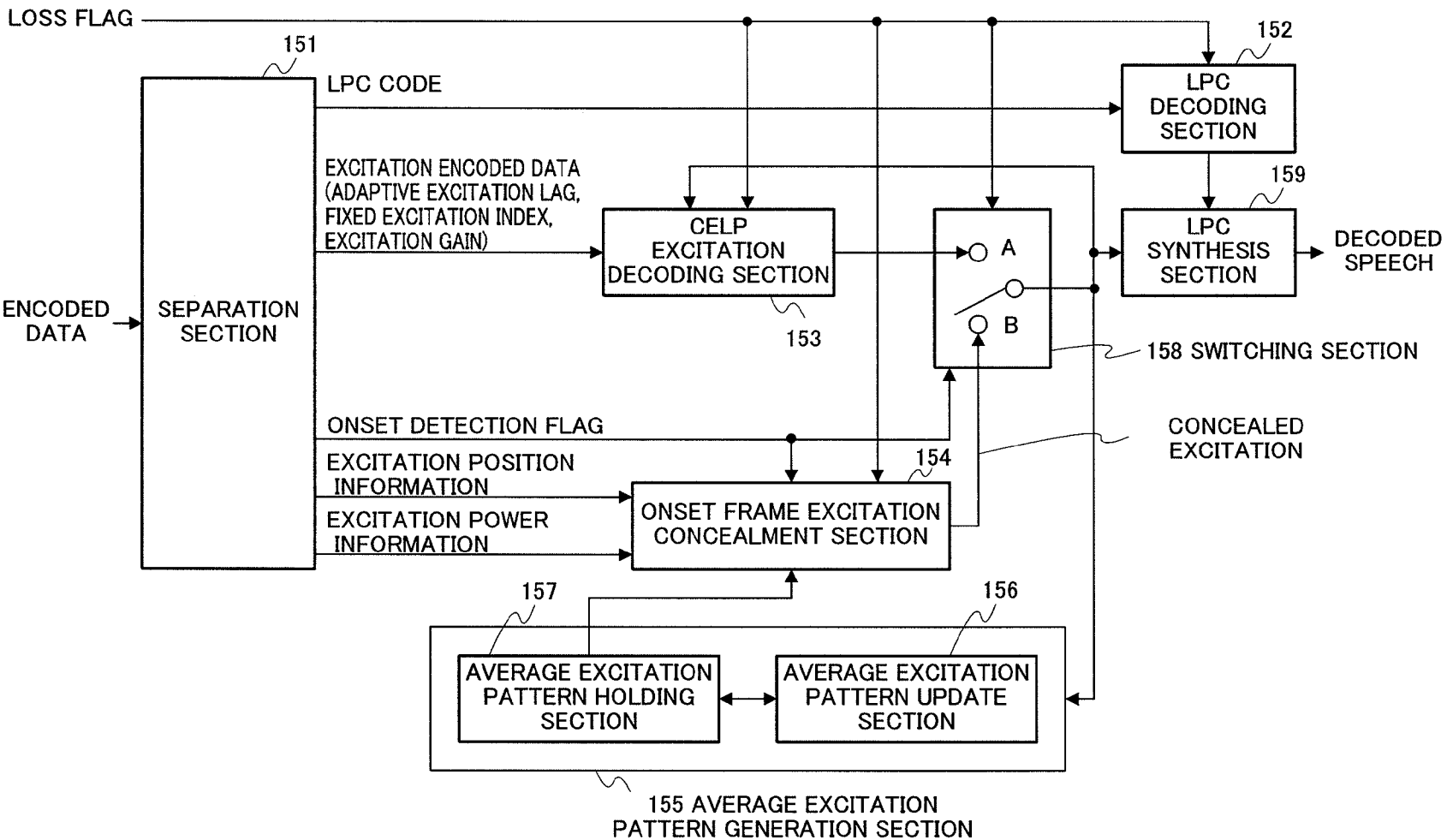
FIG. 2 is a block diagram showing the main configuration of a speech decoding apparatus according to Embodiment 1.

Next, a speech decoding apparatus according to this embodiment that decodes encoded data generated by the above speech encoding apparatus will be described. FIG. 2 is a block diagram showing the main configuration of a speech decoding apparatus according to this embodiment.

A speech decoding apparatus according to this embodiment is equipped with a frame loss detection section (not shown), separation section 151, LPC decoding section 152, CELP excitation decoding section 153, onset frame excitation concealment section 154, average excitation pattern generation section 155 (average excitation pattern update section 156, average excitation pattern holding section 157) switching section 158, and LPC synthesis section 159. The decoding side also operates in frame units in line with the encoding side.

The frame loss detection section (not shown) detects whether or not the current frame transmitted from a speech encoding apparatus according to this embodiment is a lost frame, and outputs a loss flag indicating the detection result to LPC decoding section 152, CELP excitation decoding section 153, onset frame excitation concealment section 154, and switching section 158. Here, a lost frame refers to a frame in which receive encoded data contains an error and the error is detected.

Separation section 151 separates each encoded data from input encoded data. Here, excitation position information and excitation power information are separated only if the onset detection flag contained in input encoded data indicates a voiced onset frame. However, in line with the operation of multiplexing section 104 of a speech encoding apparatus according to this embodiment, the onset detection flag, excitation position information, and excitation power information are separated together with CELP encoded data of the next frame after the current frame. That is to say, when a loss occurs for a particular frame, the onset detection flag, excitation position information, and excitation power information used to perform loss concealment for that frame are acquired at the next frame after the lost frame.

LPC decoding section 152 decodes LPC encoded data (or equivalent encoded data such as an LSP parameter) to acquire an LPC parameter. If the loss flag indicates a frame loss, LPC parameter concealment is also performed. There are various methods of performing this concealment, but generally decoding using LPC code (LPC encoded data) of the preceding frame or a decoded LPC parameter of the preceding frame is used directly. If an LPC parameter of the next frame has been obtained in decoding of the relevant lost frame, this may also be used to find a concealed LPC parameter by interpolation with a preceding frame LPC parameter.

CELP excitation decoding section 153 operates in subframe units. CELP excitation decoding section 153 decodes an excitation signal using excitation encoded data separated by separation section 151. Typically, CELP excitation decoding section 153 is provided with an adaptive excitation codebook and fixed excitation codebook, excitation encoded data includes adaptive excitation lag, a fixed excitation index, and excitation gain encoded data, and obtains a decoded excitation signal by adding an adaptive excitation and fixed excitation decoded from these after multiplication by the respective decoded gain. If the loss flag indicates frame loss, CELP excitation decoding section 153 also performs excitation signal concealment. There are various concealment methods, but generally a concealed excitation is generated by means of excitation decoding using excitation parameters (adaptive excitation lag, fixed excitation index, excitation gain) of the preceding frame. If an excitation parameter of the next frame has been obtained in decoding of the relevant lost frame, concealment that also uses this may be performed.

When the current frame is a lost frame and an onset frame, onset frame excitation concealment section 154 generates a concealed excitation signal for that frame using an average excitation pattern held by average excitation pattern holding section 157, based on excitation position information and excitation power information of that frame transmitted from a speech encoding apparatus according to this embodiment and separated by separation section 151.

Average excitation pattern generation section 155 is equipped with average excitation pattern holding section 157 and average excitation pattern update section 156. Average excitation pattern holding section 157 holds an average excitation pattern, and average excitation pattern update section 156 performs updating of the average excitation pattern held by average excitation pattern holding section 157 over a plurality of frames, using a decoded excitation signal used as input to LPC synthesis of that frame. Average excitation pattern update section 156 also operates in frame units in the same way as onset frame excitation concealment section 154 (but is not limited to this).

Switching section 158 selects an excitation signal input to LPC synthesis section 159 based on the loss flag and onset detection flag values. Specifically, switching section 158 switches output to the B side when a frame is a lost frame and an onset frame, and switches output to the A side otherwise. An excitation signal output from switching section 158 is fed back to the adaptive excitation codebook in CELP excitation decoding section 153, and the adaptive excitation codebook is thereby updated, and is used in adaptive excitation decoding of the next subframe.

LPC synthesis section 159 performs LPC synthesis using a decoded LPC parameter, and outputs a decoded speech signal. Also, in the event of frame loss, LPC synthesis section 159 performs LPC synthesis on a decoded excitation signal using a concealed excitation signal and decoded LPC parameter, and outputs a concealed decoded speech signal.

A speech decoding apparatus according to this embodiment employs the above configuration and operates as described below. Namely, a speech decoding apparatus according to this embodiment determines whether or not the current frame has been lost by referencing the value of the loss flag, and determines whether or not a voiced onset portion is present in the current frame by referencing the value of the onset detection flag. Different operations are then employed according to which of cases (a) through (c) below applies to the current frame.

(a) No frame loss (b) Frame loss and no voiced onset (c) Frame loss and voiced onset In case (a) "No frame loss"—that is, when decoding processing by means of an ordinary CELP method and average excitation pattern updating are performed—the speech decoding apparatus operates as follows. Namely, an excitation signal is decoded by CELP excitation decoding section 153 using excitation encoded data separated by separation section 151, LPC synthesis is performed in the decoded excitation signal by LPC synthesis section 159 using a decoded LPC parameter decoded by LPC decoding section 152 from LPC encoded data, and a decoded speech signal is output. Also, average excitation pattern updating is performed in average excitation pattern generation section 155 with the decoded excitation signal as input.

In case (b) "Frame loss and no voiced onset"—that is, when ordinary lost frame concealment processing is performed—the speech decoding apparatus operates as follows. Namely, excitation signal concealment is performed by CELP excitation decoding section 153, and LPC parameter concealment is performed by LPC decoding section 152. The obtained concealed excitation signal and LPC parameter are input to LPC synthesis section 159, LPC synthesis is performed, and a concealed decoded speech signal is output.

In case (c) "Frame loss and voiced onset"—that is, when lost frame concealment processing is performed using an average excitation pattern specific to this embodiment—the speech decoding apparatus operates as follows. Namely, instead of excitation signal concealment being performed by CELP excitation decoding section 153, a concealed excitation signal is generated by onset frame excitation concealment section 154. Other processing is the same as in case (b), and a concealed decoded speech signal is output.

Figure 4:
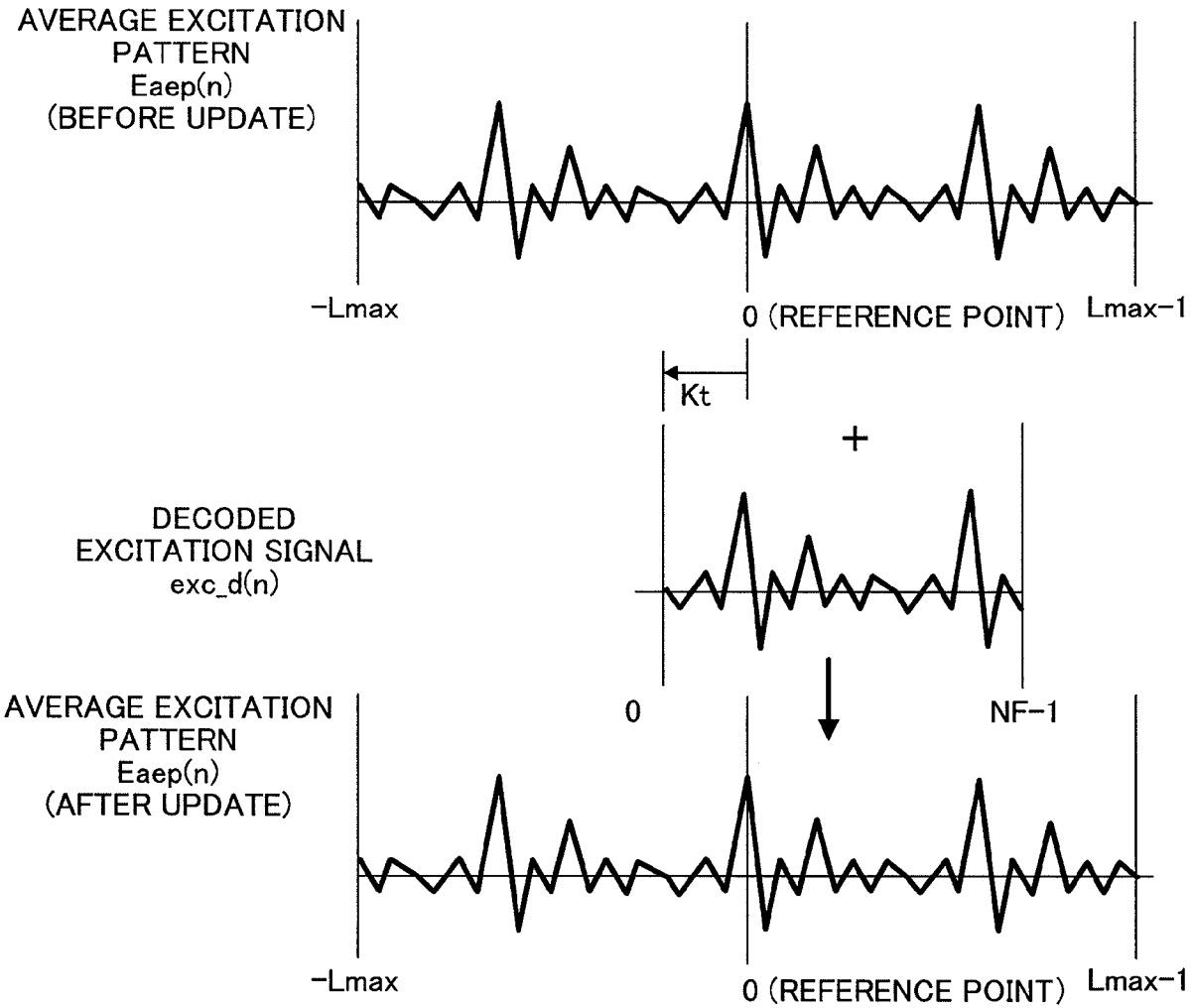
FIG. 4 is a drawing showing an overview of average excitation pattern generation (update) processing.

The average excitation pattern generation (update) method used in average excitation pattern generation section 155 will now be described in greater detail. FIG. 4 is a drawing showing an overview of average excitation pattern generation (update) processing.

In average excitation pattern generation (updating), attention is paid to the similarity of excitation signal waveform shapes, and processing is performed to enable an average excitation signal waveform pattern to be generated by repeatedly performing updating. Specifically, update processing is performed so as to generate a pitch-periodic excitation average waveform pattern (average excitation pattern). Thus, a decoded excitation signal used in updating is limited to a specific frame—specifically, a voiced frame (including an onset).

There are various methods of determining whether or not a frame is a voiced frame. For example, using a normalized maximum auto correlation value for the decoded excitation signal, a value greater than or equal to a threshold value can be determined to indicate voiced frame. A method may also be employed whereby, using a ratio of adaptive excitation power to decoded excitation power, a value greater than or equal to a threshold value is determined to indicate voiced frame. Also, a configuration may be used in which an onset detection flag transmitted and received from the encoding side is utilized.

First, a single impulse shown in Equation (1) below is used as the initial value of average excitation pattern Eaep (n) (the initial value at the start of decoding processing), and this is held in average excitation pattern holding section 157.

$$Eaep(n) = 1.0 \quad [n = 0] \qquad \text{(Equation 1)}$$
$$= 0.0 \quad [n \neq 0]$$

Then average excitation pattern updating is performed sequentially by average excitation pattern update section 156 using the following processing. Basically, a decoded excitation signal in a voiced (stationary or onset) frame is used, and average excitation pattern updating is performed by adding the shapes of two waveforms which are adjusted so that the pitch peak position and reference point coincide, as shown in Equation (2) below.

$$Eaep(n-Kt)=\alpha\times Eaep(n-Kt)+(1-\alpha)\times exc_dn(n) \quad \text{(Equation 2)}$$

where n=0, . . . , NF-1

Eaep (n): Average excitation pattern (n=−Lmax, . . . , −1, 0, 1, . . . , Lmax−1)

exc_dn (n): Decoded excitation of frame subject to updating (n=0, . . . , NF−1) (after amplitude normalization)

Kt: Update position

α: Update coefficient (0<α<1)

NF: Frame length

Kt indicates the starting point of the update position of average excitation pattern Eaep(n) using decoded excitation signal exc_d(n), Eaep(n) update position starting point Kt being set beforehand so that the pitch peak position calculated from exc_d(n) coincides with the Eaep(n) reference point.

Alternatively, Kt may be found as the start position of an Eaep(n) section in which the exc_d(n) waveform shapes are most similar. In this case, in start position Kt determination, Kt is found as a position obtained by maximization of normalized cross-correlation taking account of amplitude polarity between exc_d(n) and Eaep(n), predictive error minimization for exc_d(n) using Eaep(n), or the like.

Furthermore, in a voiced onset frame, at the time of Kt determination, pitch-periodic excitation pitch peak position information obtained by decoding encoded data indicating excitation position information may be used instead of the above calculation. That is to say, use of either a pitch peak position calculated from decoded excitation signal exc_d(n), or a pitch peak position obtained by decoding encoded data indicating excitation position information, may be selected on a frame-by-frame basis, and average excitation pattern updating performed by performing waveform placement so that pitch peak positions selected on a frame-by-frame basis coincide.

When average excitation pattern updating is performed by means of Equation (2) using Kt determined by the above processing, decoded excitation signal exc_dn(n) resulting from executing amplitude normalization taking account of polarity on decoded excitation signal exc_d(n) is used.

In the above example, a case has been described by way of example in which one frame is updated at one time, but if a decoded excitation of one frame is a pitch-period excitation of one pitch period or more, updating may also be performed with the frame divided into one-pitch-period units. Also, an average excitation pattern may be limited to a pitch-period excitation within two pitch periods including a pitch peak position (for example, with L denoting a pitch period, making the pattern range [−La, . . . , −1, 0, 1, . . . , Lb−1] (where La≦L and Lb≦L)), and updating a value outside that range as 0. Furthermore, updating may not be performed if, at update time, the similarity between a decoded excitation signal and average excitation pattern is low (if the normalized maximum cross-correlation value or predictive gain maximum value is less than or equal to a threshold value).

Figure 3:
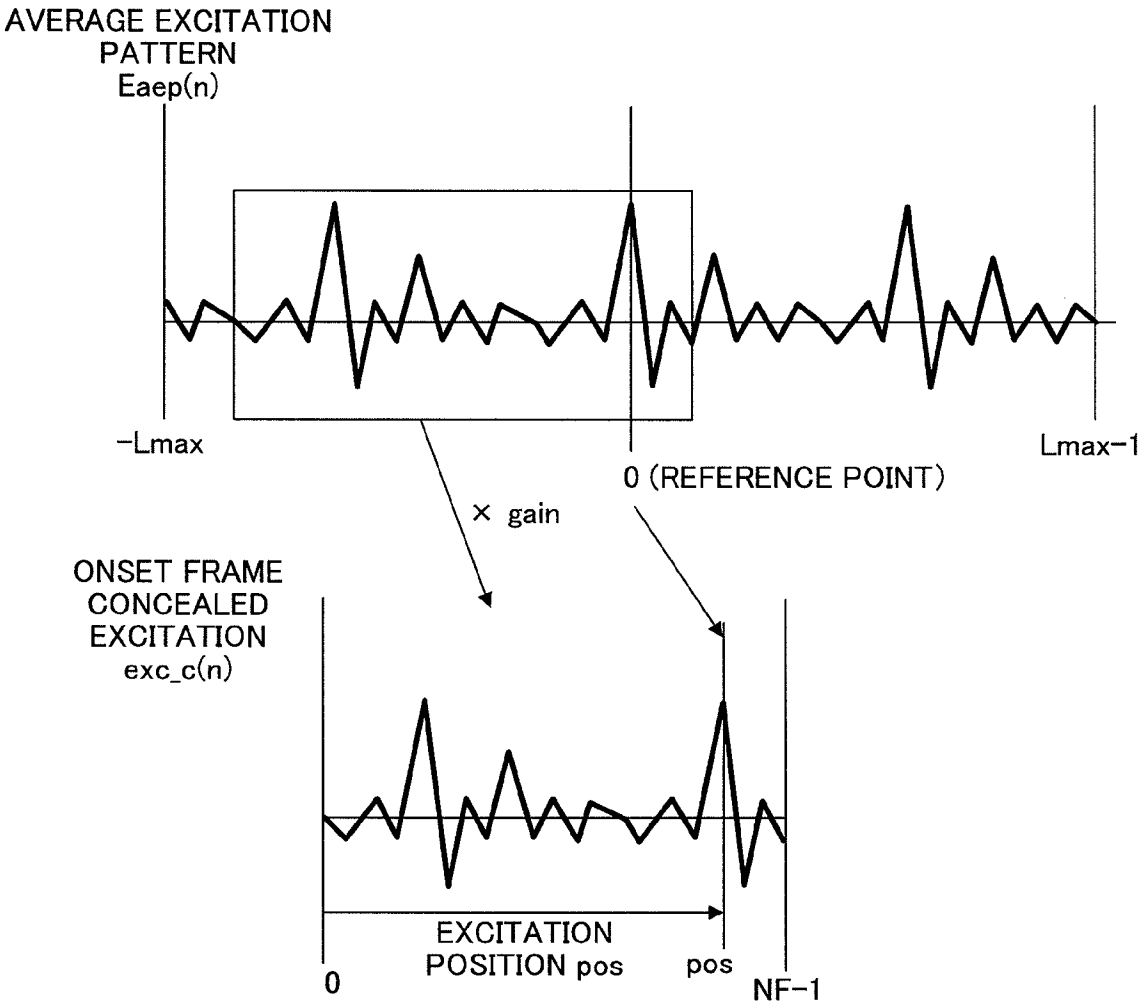
FIG. 3 is a drawing explaining a frame concealment method according to Embodiment 1.

The frame concealment method in onset frame excitation concealment section 154 will now be described in greater detail using FIG. 3.

Since a pitch peak position of a pitch-periodic excitation is obtained by decoding encoded data indicating excitation position information, an average excitation pattern is placed so that the reference point of an average excitation pattern held by average excitation pattern holding section 157 is at the position indicated by this excitation position information, and this is taken as a concealed excitation signal of a concealed frame. At this time, concealed excitation signal gain is calculated so that concealed excitation power of the frame becomes decoded excitation power using excitation power information obtained by decoding encoded data. If excitation power information has been found as an average amplitude value instead of power on the encoding side, concealed excitation signal gain is found so that the concealed excitation average amplitude value of the frame becomes the decoded average amplitude value. Also, if, on the encoding side, the polarity (positivity/negativity) of a pitch peak position excitation signal is taken as a part of excitation power information in addition to power or an average amplitude value, that polarity is taken into account and concealed excitation signal gain is found with a positive/negative sign attached.

Concealed excitation signal exc_c(n) is indicated by Equation (3) below. In Equation (3), it is assumed that an excitation pattern is generated so that the n=0 position of average excitation pattern Eaep(n) is a reference point (that is, a pitch peak position).

$$exc_c(n)=gain\times Eaep(n-pos) \quad \text{(Equation 3)}$$

where n=0, . . . , NF−1 exc_c(n): Concealed excitation signal

Eaep (n): Average excitation pattern (n=−Lmax, . . . , −1, 0, 1, . . . , Lmax−1)

pos: excitation position decoded from excitation position information gain: Concealed excitation gain NF: Frame length 2×Lmax: Pattern length of average excitation pattern Instead of performing generation by extracting a concealed excitation of an entire lost frame from an above-described average excitation pattern as shown in Equation (3) above, it is possible to extract only a one-pitch-period section and place this at a predetermined excitation position as shown in Equation (4) below.

$$exc_c(n)=gain\times Eaep(n-pos) \quad \text{(Equation 4)}$$

where, n=NF−L, . . . , NF−1. Also, L is a parameter indicating the pitch period of a pitch-period excitation: for example, a lag parameter value among CELP decoded parameters of the next frame. A concealed excitation of sections [0, . . . , NF−L−1] other than above sections [NF−L, . . . , NF−1] is silent. Also, in this case, excitation power calculated by excitation position information encoding section 103 of the encoding apparatus is calculated as the power of a corresponding one-pitch-period section.

Since an average excitation pattern obtained by average excitation pattern generation section 155 is independent of CELP speech encoding operations in the encoding apparatus, and is used only for excitation concealment in the event of frame loss on the decoding apparatus side, there is no influence on (degradation of) speech encoding and decoded speech quality in a section in which frame loss does not occur due to an effect of frame loss on average excitation pattern updating itself.

Thus, a speech decoding apparatus according to this embodiment generates an excitation signal average waveform pattern (average excitation pattern) using a decoded excitation (excitation) signal of a past plurality of frames, and generates a concealed excitation signal in a lost frame using this average excitation pattern.

As described above, a speech encoding apparatus according to this embodiment encodes and transmits information as to whether or not a frame is a voiced onset frame, pitch-periodic excitation position information, and pitch-periodic excitation power information, and a speech decoding apparatus according to this embodiment, when a frame is a lost frame and a voiced onset frame, references position information and excitation power information of the relevant frame and generates a concealed excitation signal using an average waveform pattern of excitation signal (average excitation pattern) Thus, an excitation resembling an excitation signal of a lost frame can be generated by means of concealment without information relating to the shape of an excitation signal being transmitted from the encoding side. As a result, lost frame concealment performance can be improved, and decoded speech quality can be improved.

According to this embodiment, execution of the above concealment processing is limited to a voiced onset frame. That is to say, transmission of pitch-periodic excitation position information and excitation power information applies only to specific frames. Thus, the bit rate can be reduced.

Since voiced onset frame concealment performance is improved by this embodiment, this embodiment is useful in a predictive encoding method that uses past encoded information (decoded information), and particularly in a CELP speech encoding method using an adaptive codebook. This is because adaptive excitation decoding can be performed more correctly by means of an adaptive codebook for normal frames from the next frame onward.

In this embodiment, a configuration has been described by way of example whereby encoded data indicating an onset detection flag, excitation position information, and excitation power information is multiplexed with CELP encoded data of the next frame after the relevant frame, and is transmitted, but a configuration may also be used whereby encoded data indicating an onset detection flag, excitation position information, and excitation power information is multiplexed with CELP encoded data of the frame preceding the relevant frame, and is transmitted.

In this embodiment, an example has been shown in which, when a plurality of pitch peaks are present in a frame, the position of the rear most pitch peak is encoded, but this is not a limitation, and the principle of this embodiment can also be applied to a case in which, when a plurality of pitch peaks are present in a frame, all of these pitch peak are subject to encoding.

Following variations 1 and 2 are possible for the method of calculating excitation position information in excitation position information encoding section 103 on the encoding side, and the operation of corresponding onset frame excitation concealment section 154 on the decoding side.

In variation 1, an excitation position is defined as a position one pitch period before the first pitch peak position of the next frame. In this case, excitation position information encoding section 103 on the encoding side calculates and encodes the first pitch peak position in an excitation signal of the next frame after an onset detection frame as excitation position information, and onset frame excitation concealment section 154 on the decoding side performs placement so that the average excitation pattern reference point is at the "frame length+excitation position−next frame lag value" position.

In variation 2, an optimal position is searched for by means of local decoding on the encoding side. In this case, excitation position information encoding section 103 on the encoding-side is also equipped with the same kind of configuration as onset frame excitation concealment section 154 and average excitation pattern generation section 155 on the decoding side, performs decoding-side concealed excitation generation as local decoding on the encoding side also, searches for a position at which the generated concealed excitation is optimal as a position at which distortion is minimal for input speech or loss-free decoded speech, and encodes the obtained excitation position information. The operation of onset frame excitation concealment section 154 on the decoding-side is as already described.

CELP encoding section 101 according to this embodiment may be replaced by an encoding section employing another encoding method whereby speech is decoded using an excitation signal and LPC synthesis filter, such as multipulse encoding, an LPC vocoder, or TCX encoding, for example.

This embodiment may also have a configuration whereby packetization and transmission as IP packets is performed. In this case, CELP encoded data and other encoded data (onset detection flag, excitation position information, excitation power information) may be transmitted in separate packets. On the decoding side, separately received packets are separated into respective encoded data by separation section 151. In this system, lost frames include frames that cannot be received due to packet loss.

This concludes a description of an embodiment of the present invention.

A speech encoding apparatus and lost frame concealment method according to the present invention are not limited to the above-described embodiment, and various variations and modifications may be possible without departing from the scope of the present invention.

For example, the invention of the present application can also be applied to a speech encoding apparatus and speech decoding apparatus with a scalable configuration—that is, comprising a core layer and one or more enhancement layers. In this case, all or part of the information comprising an onset detection flag, excitation position information, and excitation power information transmitted from the encoding side, described in the above embodiment, can be transmitted in an enhancement layer. On the decoding side, in the event of a core layer frame loss, frame loss concealment using an above-described average excitation pattern is performed based on the information (onset detection flag, excitation position information, and excitation power information) decoded in the enhancement layer.

In this embodiment, a mode has been described by way of example in which concealed excitation generation for a loss concealed frame using an average excitation pattern is applied only to a voiced onset frame, but it is also possible for a frame containing a transition point from a signal without pitch periodicity (a unvoiced consonant or background noise signal or the like) to a voiced speech with pitch periodicity, or frame containing a voiced transient portion in which there is pitch periodicity but an excitation signal characteristic (pitch period or excitation shape) changes—that is, a frame for which normal concealment using a decoded excitation of a preceding frame cannot be performed appropriately—to be detected on the encoding side as an applicable frame, and application is made to that frame.

A configuration may also be used whereby, instead of explicitly detecting a specific frame as described above, application is made to a frame for which excitation concealment using a decoding-side average excitation pattern is determined to be effective. In this case, a determination section that determines such effectiveness is provided instead of an encoding-side voiced onset detection section. The operation of such a determination section would involve, for example, performing both excitation concealment using an average excitation pattern performed on the decoding side and ordinary excitation concealment that does not use an average excitation pattern (concealment with a past excitation parameter or the like), and determining which of these concealed excitations is more effective. That is to say, it would be determined by means of SNR or such like evaluation whether or not concealed decoded speech obtained by means of the concealed excitation is closer to loss-free decoded speech.

In the above embodiment, a case has been described by way of example in which a decoding-side average excitation pattern is of only one kind, but a plurality of average excitation patterns may also be provided, one of which is selected and used in lost frame excitation concealment. For example, a plurality of pitch period excitation patterns may be provided according to decoded speech (or decoded excitation signal) characteristics. Here, decoded speech (or decoded excitation signal) characteristics are, for example, pitch period or degree of voicedness, LPC spectrum characteristics or associated variation characteristics, and so forth, and those values are classified into classes in frame units using CELP encoded data adaptive excitation lag or a decoded excitation signal normalized maximum auto correlation value, for example, and updating of average excitation patterns corresponding to the respective classes is performed in accordance with the method described in the above embodiment. An average excitation pattern is not limited to a pitch period excitation shape pattern, and patterns for an unvoiced portion or inactive speech portion without pitch periodicity, and a background noise signal, for example, may also be provided. Then, on the encoding side, which pattern is used for a frame-unit input signal is determined based on a parameter corresponding to a characteristic parameter used for average excitation pattern classification and conveyed to the decoding side, or an average excitation pattern used by a decoding-side lost frame is selected on the decoding side based on a speech decoded parameter (corresponding to a characteristic parameter used for average excitation pattern classification) of the next frame after (or frame preceding) the relevant lost frame, and used for excitation concealment. Increasing the number of average excitation pattern variations in this way enables concealment to be performed using an excitation pattern more appropriate to (more similar in shape to) a particular lost frame.

It is possible for a speech decoding apparatus and speech encoding apparatus according to the present invention to be installed in a communication terminal apparatus and base station apparatus in a mobile communication system, by which means a communication terminal apparatus, base station apparatus, and mobile communication system can be provided that have the same kind of operational effects as described above.

A case has here been described by way of example in which the present invention is configured as hardware, but it is also possible for the present invention to be implemented by software. For example, the same kind of functions as those of a speech decoding apparatus according to the present invention can be implemented by writing an algorithm of a lost frame concealment method according to the present invention in a programming language, storing this program in memory, and having it executed by an information processing means.

The function blocks used in the description of the above embodiment are typically implemented as LSIs, which are integrated circuits. These may be implemented individually as single chips, or a single chip may incorporate some or all of them.

Here, the term LSI has been used, but the terms IC, system LSI, super LSI, ultra LSI, and so forth may also be used according to differences in the degree of integration.

The method of implementing integrated circuitry is not limited to LSI, and implementation by means of dedicated circuitry or a general-purpose processor may also be used. An FPGA (Field Programmable Gate Array) for which programming is possible after LSI fabrication, or a reconfigurable processor allowing reconfiguration of circuit cell connections and settings within an LSI, may also be used.

In the event of the introduction of an integrated circuit implementation technology whereby LSI is replaced by a different technology as an advance in, or derivation from, semiconductor technology, integration of the function blocks may of course be performed using that technology. The application of biotechnology or the like is also a possibility.

The disclosure of Japanese Patent Application No. 2006-192070, filed on Jul. 12, 2006, including the specification, drawings and abstract, is incorporated herein by reference in its entirety.

INDUSTRIAL APPLICABILITY

A speech decoding apparatus, speech encoding apparatus, and lost frame concealment method according to the present invention can be applied to such uses as a communication terminal apparatus or base station apparatus in a mobile communication system.

The invention claimed is:

1. A speech decoding apparatus comprising:

a decoder, embodied as a processor, that decodes input encoded data to generate a decoded signal;

a generator, embodied as a processor, that generates an average waveform pattern of excitation signals in a plurality of frames using an excitation signal obtained in the decoding of the encoded data;

a concealed frame generator, embodied as a processor, that generates a concealed frame of a lost frame using the average waveform pattern;

a switch that selects one of the decoded signal generated by the decoder and the lost frame signal generated by the concealed frame generator; and a determiner that determines whether or not the lost frame contains a voiced onset signal, wherein, when the determiner determines that the lost frame does not contain a voiced onset signal, the decoder performs CELP excitation signal concealment to generate the decoded signal, and the switch selects the decoded signal generated by the decoder, and when the determiner determines that the lost frame contains a voiced onset signal, switch selects the concealed frame generated by the concealed frame generator.

2. The speech decoding apparatus according to claim 1, wherein the concealed frame generator generates the concealed frame by placing the average waveform pattern in accordance with a pitch peak position of the lost frame obtained from excitation position information contained in the encoded data.

3. The speech decoding apparatus according to claim 1, wherein the generator generates the average waveform pattern by placing and adding the excitation signals of a plurality of frames which are adjusted so that pitch peak positions of each frame found from the excitation signals coincide.

4. The speech decoding apparatus according to claim 3, wherein the generator generates the average waveform pattern using a signal within a predetermined range from the pitch peak position among the excitation signals.

5. The speech decoding apparatus according to claim 1, wherein the generator selects on a frame-by-frame basis either a first pitch peak position found from the excitation signal or a second pitch peak position obtained from excitation position information contained in the encoded data, and generates the average waveform pattern by placing and adding the excitation signals of a plurality of frames which are adjusted so that pitch peak positions of the plurality of frames coincide one another, each of the pitch peak positions being selected, on a frame-by-frame basis, from the first and second pitch peak positions.

6. The speech decoding apparatus according to claim 5, wherein the generator generates the average waveform pattern using a signal within a predetermined range from either the first pitch peak position or the second pitch peak position selected from among the excitation signals.

7. The speech decoding apparatus according to claim 1, further comprising a determiner that determines whether or not a frame contains a voiced onset signal, wherein the generator generates the average waveform pattern using a frame determined to contain a voiced onset signal.

8. A speech encoding apparatus corresponding to the speech decoding apparatus according to claim 1, the speech encoding apparatus comprising:

an encoder that generates the encoded data of information relating to a position and power of a pitch peak of an input speech signal; and an outputter that outputs the encoded data to the speech decoding apparatus.

9. A communication terminal apparatus comprising the speech decoding apparatus according to claim 1.

10. A base station apparatus comprising the speech decoding apparatus according to claim 1.

11. A lost frame concealment method comprising:

decoding, by a processor, input encoded data to generate a decoded signal;

generating, by a processor, an average waveform pattern of excitation signals in a plurality of frames using an excitation signal obtained in the decoding of the encoded data;

generating, by a processor, a concealed frame of a lost frame using the average waveform pattern;

selecting, by a switch, one of the decoded signal and the concealed frame to be output; and determining whether or not the lost frame contains a voiced onset signal, wherein, when it is determined that the lost frame does not contain a voiced onset signal, the decoding performs CELP excitation signal concealment to generate the decoded signal, and the selecting selects the decoded signal, and when it is determined that the lost frame contain a voiced onset signal, the selecting selects the concealed frame.

12. The lost frame concealment method according to claim 11, wherein the concealed frame is generated by placing the average waveform pattern in accordance with a pitch peak position of the lost frame obtained from excitation position information contained in the encoded data.

13. The lost frame concealment method according to claim 11, wherein the average waveform pattern is generated by placing and adding the excitation signals of a plurality of frames which are adjusted so that pitch peak positions of each frame found from the excitation signals coincide.

14. The lost frame concealment method according to claim 13, wherein the average waveform pattern is generated using a signal within a predetermined range from the pitch peak position among the excitation signals.

15. The lost frame concealment method according to claim 11, further comprising selecting, on a frame-by-frame basis, either a first pitch peak position found from the excitation signal or a second pitch peak position obtained from excitation position information contained in the encoded data, wherein the average waveform pattern is generated by placing and adding the excitation signals of a plurality of frames which are adjusted so that pitch peak positions of the plurality of frames coincide one another, each of the pitch peak positions being selected, on a frame-by-frame basis, from the first and second pitch peak positions.

16. The lost frame concealment method according to claim 11, further comprising determining whether or not a frame contains a voiced onset signal, wherein the average waveform pattern is generated using a frame determined to contain a voiced onset signal.

* * * * *

UNITED STATES PATENT AND TRADEMARK OFFICE

CERTIFICATE OF CORRECTION

PATENT NO. : 8,255,213 B2
APPLICATION NO. : 12/373085
DATED : August 28, 2012
INVENTOR(S) : Koji Yoshida et al.

It is certified that error appears in the above-identified patent and that said Letters Patent is hereby corrected as shown below:

At column 13, line 3 (claim 5, line 9), “coincide one” should read -- coincide with one --.

At column 14, line 30 (claim 15, line 9), “coincide one” should read -- coincide with one --.

Signed and Sealed this
Sixth Day of November, 2012

David J. Kappos

David J. Kappos
*Director of the United States Patent and Trademark Office*